US007267233B2

(12) United States Patent
Carvagno et al.

(10) Patent No.: US 7,267,233 B2
(45) Date of Patent: Sep. 11, 2007

(54) IN-LINE CLASSIFIER FOR POWDERED PRODUCTS

(75) Inventors: Lawrence Carvagno, Bulls Gap, TN (US); William L. Cook, Kingsport, TN (US); Ronald Keith Dailey, Jonesborough, TN (US); Jacob Anthony Southerland, Jonesborough, TN (US)

(73) Assignee: Eastman Chemical Company, Kingsport, TN (US)

( * ) Notice: Subject to any disclaimer, the term of this patent is extended or adjusted under 35 U.S.C. 154(b) by 329 days.

(21) Appl. No.: 10/753,231

(22) Filed: Jan. 7, 2004

(65) Prior Publication Data

US 2005/0155912 A1 Jul. 21, 2005

(51) Int. Cl.
*B07C 5/00* (2006.01)
*B07B 4/00* (2006.01)
*B07B 7/00* (2006.01)

(52) U.S. Cl. ..... 209/638; 209/631; 209/637; 209/640; 209/133; 209/135

(58) Field of Classification Search ..... 209/637, 209/638, 640, 641, 639, 133, 134, 135, 143, 209/138, 139.1, 631
See application file for complete search history.

(56) References Cited

U.S. PATENT DOCUMENTS

| | | | | |
|---|---|---|---|---|
| 21,945 | A * | 11/1858 | Cox | 209/137 |
| 393,411 | A * | 11/1888 | Willis | 209/139.1 |
| 786,184 | A * | 3/1905 | Benefield | 209/143 |
| 840,724 | A * | 1/1907 | Sweet | 209/143 |
| 1,002,131 | A * | 8/1911 | Broome | 209/135 |
| 1,003,884 | A * | 9/1911 | Davis | 209/135 |
| 1,024,297 | A * | 4/1912 | Thompson | 209/135 |
| 1,054,183 | A * | 2/1913 | Davis | 209/135 |
| 1,159,168 | A * | 11/1915 | Broome | 209/135 |
| 1,360,834 | A * | 11/1920 | Wallace et al. | 209/142 |
| 1,987,640 | A * | 1/1935 | Rothgarn | 209/136 |
| 2,681,476 | A * | 6/1954 | Van Doom | 209/137 |
| 2,850,162 | A * | 9/1958 | Widmer | 209/134 |
| 2,968,400 | A * | 1/1961 | Clute | 209/143 |

(Continued)

FOREIGN PATENT DOCUMENTS

| | | |
|---|---|---|
| DE | 3330733 | 4/1984 |

(Continued)

OTHER PUBLICATIONS

Notification of Transmittal of the International Search Report and the Written Opinion of the International Searching Authority, or the Declaration dated May 17, 2005.

(Continued)

*Primary Examiner*—Patrick Mackey
*Assistant Examiner*—Mark Hageman
(74) *Attorney, Agent, or Firm*—Steven A. Owen; Brett L. Nelson; Bernard J. Graves, Jr.

(57) ABSTRACT

A classifier for classifying particulates entrained in a flowing stream of gas is configured such that a change of direction of gas flow causes particles to impinge upon a target, heavier particles being trapped in a downwardly extending fluidized trap. The classifier is easily constructed, has no moving parts, and can take the place of sifters and other equipment traditionally used for classifying such product streams.

23 Claims, 2 Drawing Sheets

U.S. PATENT DOCUMENTS

| | | | | | |
|---|---|---|---|---|---|
| 3,308,945 | A | * | 3/1967 | Oja | 209/3 |
| 3,354,923 | A | * | 11/1967 | Voller | 426/481 |
| 3,447,678 | A | * | 6/1969 | Henry | 209/3 |
| 4,089,422 | A | * | 5/1978 | Harmke et al. | 209/137 |
| 4,441,994 | A | * | 4/1984 | Beneke et al. | 209/139.1 |
| 4,574,045 | A | * | 3/1986 | Crossmore, Jr. | 44/580 |
| 4,743,363 | A | | 5/1988 | Darrow | |
| 4,853,112 | A | * | 8/1989 | Brown | 209/142 |
| 4,908,123 | A | * | 3/1990 | Miers | 209/133 |
| 4,988,373 | A | * | 1/1991 | Marzoli et al. | 55/461 |
| 5,106,487 | A | * | 4/1992 | Nemedi | 209/44.2 |
| 5,290,431 | A | * | 3/1994 | Cunningham | 208/164 |
| 5,348,163 | A | * | 9/1994 | Tunison et al. | 209/135 |
| 5,366,094 | A | * | 11/1994 | Stein | 209/138 |
| 5,392,998 | A | * | 2/1995 | Suessegger et al. | 241/79.1 |
| 5,411,142 | A | * | 5/1995 | Abbott et al. | 209/29 |
| 5,417,330 | A | * | 5/1995 | Heyl | 209/140 |
| 6,253,923 | B1 | * | 7/2001 | Felkins | 209/137 |
| 6,347,707 | B1 | * | 2/2002 | Sussegger et al. | 209/143 |
| 6,568,536 | B2 | * | 5/2003 | Tanaka et al. | 209/139.2 |
| 6,644,479 | B1 | * | 11/2003 | Kimmeyer et al. | 209/154 |
| 6,672,461 | B2 | * | 1/2004 | Miller et al. | 209/722 |

FOREIGN PATENT DOCUMENTS

| | | |
|---|---|---|
| DE | 195 10 923 A1 | 10/1996 |
| FR | 2163545 | 12/1972 |
| JP | 62160174 | 7/1987 |
| JP | 5050040 | 3/1993 |

OTHER PUBLICATIONS

HammerTek Corporation Advertisement, Gravity Diverter Valves, Powder/Bulk Solids, Oct. 2002, pp. 35, vol. 20, No. 10, Reed Business Information, Colorado.

* cited by examiner

IN-LINE CLASSIFIER FOR POWDERED PRODUCTS

BACKGROUND OF THE INVENTION

1. Field of the Invention

The present invention pertains to the classification of particulate solids in chemical manufacturing processes, more particularly, to the efficient removal of large particulates, agglomerates, and foreign matter from a gas-transported stream of particulate product.

2. Background Art

In chemical manufacturing processes, it is frequently desired to provide a pulverulent or nearly dry product of defined particle size range. For example, in many chemical processes, a moist product filter cake is obtained which is broken up and dried in a gas stream, for example in a fluidized bed dryer. A product stream containing product particles depleted of water and/or organic solvents is conveyed-by entrainment in a gas stream, to a packaging or shipping station. Additional "drying" may take place in the conveying gas stream, and the product may be completely dry or may still contain traces of liquid.

For many products, a defined range of particle sizes is desired, and freedom from large particulates and agglomerates is often a necessary requirement. Large particulates may be artifacts of crystallization processes employed to isolate and/or purify the product. Agglomerates may be created during these processes as well, or during drying in the drying apparatus. Creation of agglomerates or "sintering" is more likely to occur with products which are inherently tacky, or where the drying temperature is close to the product softening or melting temperature. Low gas velocities in fluid bed dryers generally exacerbate such large particle formation. Large particles may also result from sloughing off of product accumulated on reactor walls or in the dryer or conveying lines. Such particles may or may not have the same chemical composition as the desired product. Foreign matter such as metal pieces, deteriorated pump seals, etc., may be introduced into the product at various stages of processing.

In the past, mechanical sifters have been used to classify such particulate products. In such devices, perforated plates or metal screens are employed to trap particulates larger than the mesh size of the screens or plates. The retained large particles must be periodically removed. Such sifters are bulky, have numerous moving parts and are thus amenable to failure, and represent significant capital cost. Examples of commercial sifters include centrifugal sifters available from Prater Industries, Inc., Cicero, Ill., as the Roto-Sieve™, and the Roto-Trap™. Sifters generally also produce shearing of the particles, which is generally undesirable. The amount of "fines" often increases as a result.

It would be desirable to provide a classifying apparatus, or "classifier," which is free of moving parts, yet which is capable of efficiently classifying a moving particle stream by removing large particles, agglomerates, foreign matter, etc., from the particle stream.

SUMMARY OF THE INVENTION

It has now been surprisingly discovered that efficient classification of particles in moving particle streams can be achieved by directing the gas-entrained particles through a bend, in which is mounted an oblique target. Small particles sweep through the bend, while large particles impact the target and fall into a trap through which fluidizing gas flows.

DETAILED DESCRIPTION OF THE PREFERRED EMBODIMENTS

Figure 1:
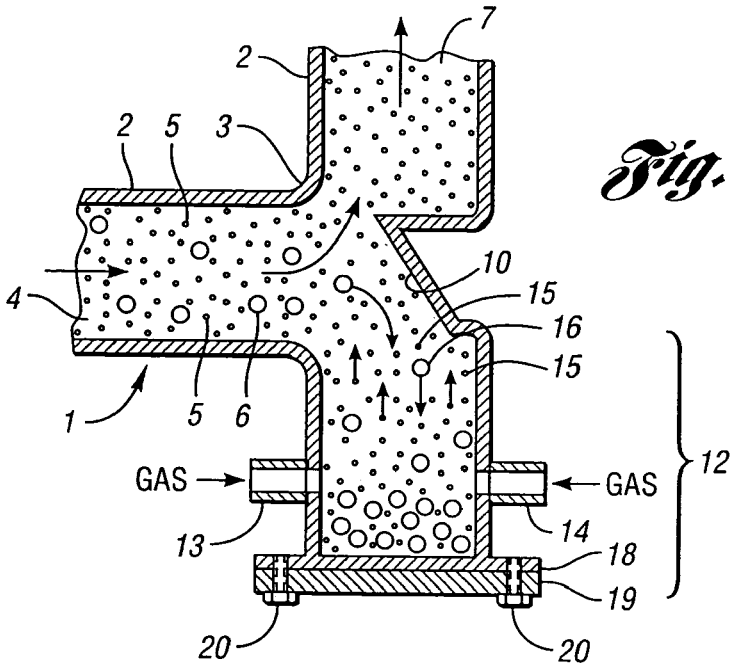
FIG. 1 is a simplified embodiment of the subject invention classifier to illustrate the manner of operation.

The subject invention classifier is useful with all types of particulate products conveyed by a flow of gas, regardless of their method of preparation. For example, but not by limitation, the classifier is useful with products which may have been produced by spray drying, by crystallization from solution followed by solvent removal, by freeze-drying, etc. The classifier is also useful for treatment of streams of particles which may have been produced by grinding, shredding, pulverizing, etc. The classifier is particularly useful for organic and inorganic chemical products which have been initially freed of any solvent ("dried") to an extent where the particles may be entrained within and conveyed by a flow of gas. Examples include, but are not limited to, pigments, dyes, and organic acids, as well as polymer solids, including particulate polymers produced by granulating or pelletizing from the melt. The classifier is particularly useful for classifying particulate aromatic acids, including sulfonic acids, and particularly aromatic mono-, di-, and tricarboxylic acids such as benzoic acid, phthalic acid, isophthalic acid, terephthalic acid, naphthalene dicarboxylic acids, and the like. By "particulate product" and like terms is meant a solid product in particulate form.

The particulates which are classified are generally dry, i.e., are free of solvent and/or other liquid impurities to the extent that they are conveyable in a gas stream without excessive agglomeration or clumping. In general, the "dryness" of the particulates is no different from that of particulates which are classified by sifters and like devices. In other words, the classifier of the present invention may be used as a "drop-in" replacement for conventional sifters, etc., without necessitating process changes to alter the nature of the particulates.

The classifier of the present invention comprises a conduit through which particulates entrained in gas flow, this conduit having a bend therein necessitating a change in the direction of flow. At this point, the conduit contains a target surface imposed across the initial direction of gas flow and preferably angled downwardly with respect to gravity and away from the direction of flow. The gas flow rate is such that smaller particles flow through the bend in the flow direction without impacting the target, or impact the target and rebound, being swept by the gas flow into the conduit. Heavier particles, however, impact the target and due to their higher weight or density, fall vertically into a trap, which is then emptied periodically. The trap is fluidized with a flow of gas which encourages smaller particles to remain in the principle gas stream or to rejoin the principle gas stream from the trap. Thus, the trap retains larger particulates, foreign objects, and the like. The operation of one embodiment of such a classifier is shown in cross-section in FIG. 1. The details have been simplified to clarify the operation of the classifier.

In FIG. 1, the classifier 1 consists of a conduit 2 having a bend 3 which forces a change in direction of the inlet flow stream 4. The inlet flow stream comprises both small particles 5, and larger particles 6 whose removal is desired. As the inlet flow stream rounds the bend in the conduit, the small particles remain predominately in the entraining gas, and continue as an outlet flow stream 7.

Positioned across the initial direction of gas flow is target 10. Some of the small particles 5 impact the target and rejoin the entraining gas stream, while a smaller number leave the entraining gas stream and enter trap 12. However, virtually-all larger particles impact the target and enter the trap 12. Trap 12 is fluidized, in this embodiment by two streams of gas entering the trap through fluidizing gas inlets 13 and 14. The flow of gas is adjusted so as to allow large particles 16 to continue their descent into the trap, and fluidizing small particles 15 to allow these heavier or denser particles to sink to the bottom of the trap. The fluidizing gas also serves the purpose of encouraging small particles which rebound from the target to re-enter the flowing gas stream rather than descend into the trap. At the bottom of the trap is a flange 18, to which is secured closure plate 19 by bolts 20. When the trap is to be emptied, the gas flows can be stopped and the bottom closure removed. Such a method of emptying the trap is not optimal for use as a commercial embodiment, but illustrates the principles involved. This embodiment may be satisfactory for use in some processes, however.

Figure 2:
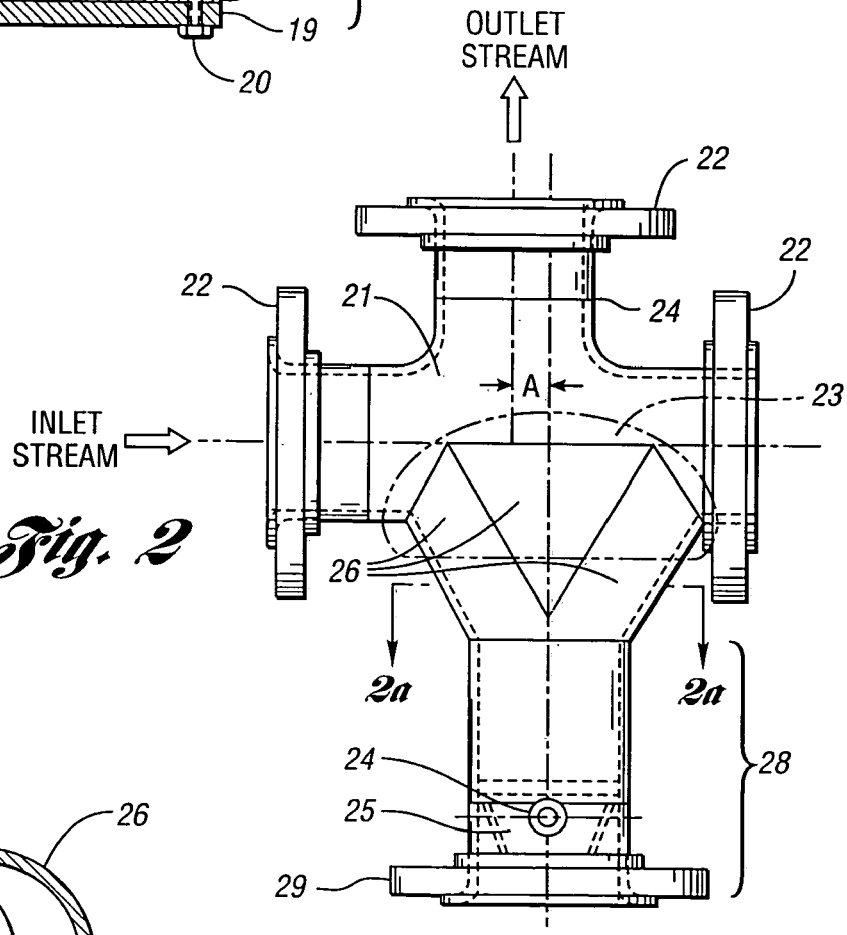
FIG. 2 is an elevation of one embodiment of the subject invention classifier without the target.

One of the benefits of the subject classifier is its simplicity, which leads to it being able to be constructed, in part, from standard fittings used in the chemical industry. A commercially viable classifier is shown in FIGS. 2-6. In FIG. 2, one embodiment 20 of a commercial device is shown in elevation. In elevation, the device starts out as a standard 4-inch (10 cm) schedule 10 stainless steel Tee fitting 21, configured for standard 4-inch slip on flanges 22.

Figure 2A:
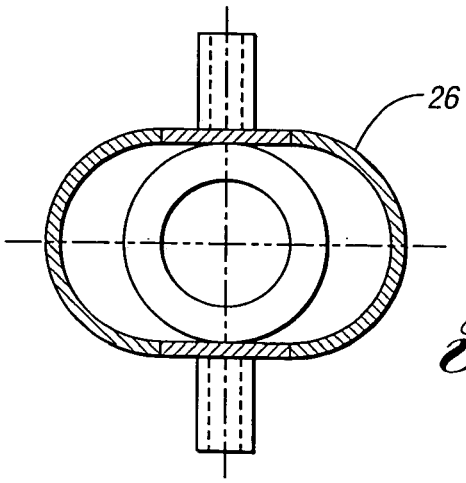
FIG. 2*a* is a cross-section across 2*a*-2*a* of FIG. 2.

A portion of the bottommost section 23 of the Tee 21 is removed, this removed section preferably being somewhat off-center relative to the upward extending portion 24 of the Tee by an amount A. This offset A is preferably in the range of 0.5 inch (1.27 cm) to 1.5 inches (3.81 cm), more preferably about 1.1 inches (2.79 cm) in a standard 4-inch (10 cm) Tee. However, depending upon the size of the Tee and the configuration of the target, no offset in the direction of the target or even an offset in the opposite direction, i.e., toward the inlet is possible. Into the retained portion of the Tee, with the aid of filler plates 26, is welded trap 28, also terminated by a flanged fitting 29. A section 2*a*-2*a* across the merged trap and Tee cutaway is shown in FIG. 2*a*.

Figure 4:
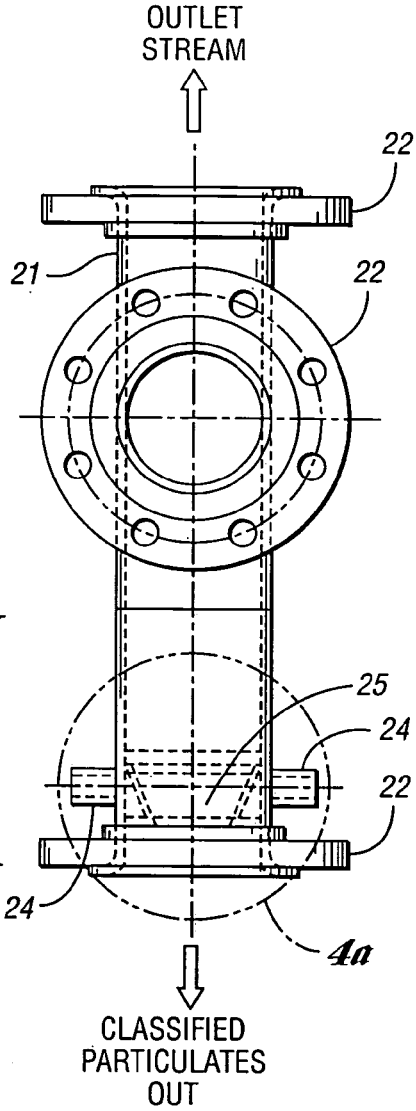
FIG. 4 illustrates the embodiment of FIG. 2 in a side view.
Figure 4A:
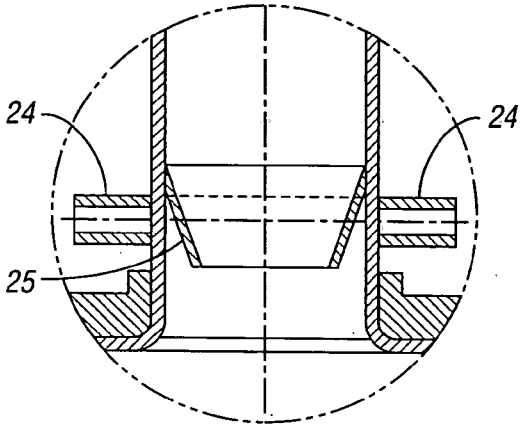
FIG. 4*a* is a detail of the circled portion 4*a* of FIG. 4.
Figure 5:
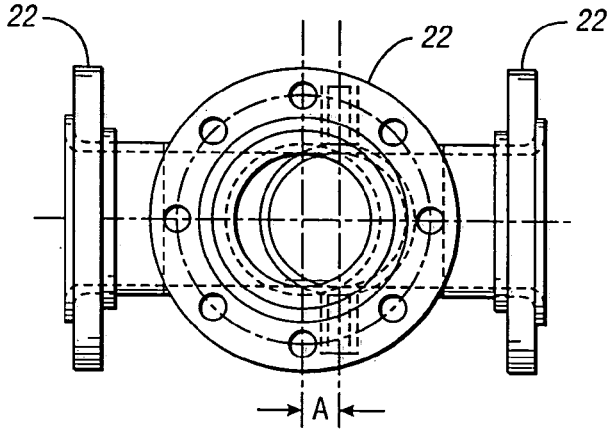
FIG. 5 is a top view of the embodiment of FIG. 2.

FIG. 4 illustrates the classifier in a side view, while FIG. 5 illustrates a top view. An enlarged detail of one preferred embodiment of the trap 28 is shown in FIG. 4*a*, which will be described later.

Figure 3:
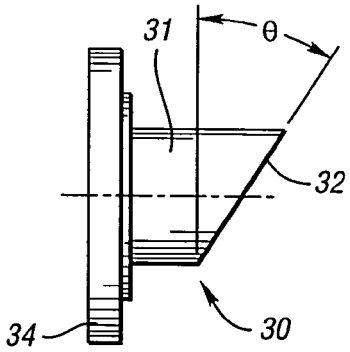
FIG. 3 illustrates one embodiment of an insert which may be fixed to the embodiment of FIG. 2 to provide a target.

In FIG. 3 is shown an insert which comprises one means of supplying a target within the flow stream of the device. Other means of providing a target, including permanently welding a target within the Tee are, also useful. However, the present method allows the target to be replaced when needed (e.g., due to abrasion or corrosion), to be reconfigured with a larger or smaller target or one having a different impact angle with respect to the incoming gas stream, and to facilitate cleaning and maintenance of the classifier. This design also allows for one basic design to be manufactured for use with different targets, depending upon the particular product in need of classification and the nature of the products removed.

In FIG. 3, the insert 30 comprises target rod 31, in the form of a solid rod having an-outside diameter such that the target may be received by the rightmost portion of Tee 21. The target rod is terminated by target face 32. The face may be planar or contoured, and preferably is not orthogonal to the inlet stream flow direction, but presents a downwardly sloping face, at an angle 2 to the inlet stream flow direction 2 is preferably from 10° to 60°, more preferably 20° to 45°, and most preferably 25° to 35°. In FIG. 3, 2 is 30°. The rod is mounted, e.g., by welding or the like, to a blind flange 34 of the same size and bolt pattern as the slip-on flange on the rightmost portion of the Tee 21. The diameter of the target rod 31 is preferably just slightly smaller than the inside, diameter of the Tee.

FIG. 4*a* illustrates one embodiment of a fluidized trap in detail. The trap 28 contains a conical fitting 25 welded or otherwise fixed in place in the trap. Below the conical fitting, and preferably located vertically in the wall of the trap within the depth of the conical fitting, are fluidizing gas inlets 24. One or a plurality of fluidizing gas inlets, preferably spaced with radial symmetry, may be used. The depth of the trap below the cone may be made deeper to accommodate a larger volume of trapped particulates, or a bolted-on extension may be used for this purpose. The fluidizing gas keeps the fine particles above the conical portion of the trap in a fluid particulate state, which allows the heavier or denser particles to sink and ultimately remain below the conical fitting. In lieu of a conical fitting, no fitting may be used, or a simple restrictive ring may be used, with the fluidizing gas inlets preferably positioned below the ring. The conical fitting shown is tapered at an angle of 20°, although taper angles of 5° to 45° may be useful as well. In the embodiment shown, the fluidizing gas inlets are centered at 0.3 inch (0.76 cm) below the point where the conical fitting 25 is welded to the trap walls.

Particulates caught in the trap are preferably removed via an air lock, for example a series of two valves with or without a length of piping therebetween. Numerous configurations are possible, and are easily designed by a process engineer of ordinary skill in the art. The volume between the two valves may be evacuated prior to opening the valve which provides communication with the trap, if desired. In lieu of an air lock discharge, a simple unitary valve may be used. In such a case, provision must be made to accommodate a relatively high velocity flow from the valve, and some disruption of the particulate-laden gas stream may occur. For these reasons, it is preferable to employ an air lock, lock box, or similar device. The outlet is preferably tapped at intervals, which may be set by process equipment such as programmable logic controllers, or may be manually actuated.

It is desirable that the trap initially contain some fine particulate solids. These solids, in their fluidized state, act as a Catch basin which encourages trapping of large particulates by absorbing their kinetic energy. The trap can be initially filled with fine particulates if desired, but ordinarily, the larger volume within the classifier as compared to the piping leading to the classifier causes an initial decrease in the gas velocity, which causes fine particles to initially be deposited in the trap. The fluidizing gas leaving the trap prevents an accumulation of fine particles which would obscure the target.

While the classifying device illustrated by FIGS. 2 through 5, is described as being based on standard and readily available components, such a construction is not necessary, and the classifiers may be produced otherwise as well. For example, a single casting embodying the components of FIG. 2, of or FIG. 2 and the remaining figures as well, can be used. Such a fitting may be made of any material suitable for the process. For example, particularly in non-corrosive environments, cast steel, cast iron, or even aluminum or aluminum alloys may be used, while in more corrosive environments, metals such as stainless steel, Hastelloy, titanium, zirconium, or tantalum may be used. The devices may also be cast and then dipped, coated, flame-sprayed, etc., with corrosion-resistant or abrasion-resistant alloys, or may be glass-coated or porcelainized. For applications involving low pressures and generally, low temperatures, even polymers, preferably fiber-reinforced polymers, may be used. In such cases, it is generally desirable to employ a metal target, or a polymer target onto which a metal target surface has been mounted.

The trap must be located in a downwardly extending fashion from the bend in the gas flow, or from a space or "volume" in the classifier in which the target is mounted, in order that the particles desired to be removed from the particulate-laden gas flow may fall into the trap with the aid of gravity. However, the trap need not be vertical, but may be positioned at an angle, i.e., need not be angled 90° to the inlet gas flow direction. A 90° orientation is useful for purposes of fabrication and installation, but any angle which permits efficient operation of the classifier may be used. These angles are preferably included angles, relative to the direction of incoming gas flow, of from 30° to 150°, more preferably 45° to 135°, yet more preferably from 60° to 120°, and most preferably from 80° to 100°, i.e., substantially vertical. More than one target, and/or more than one trap may be used, if desired, but this is not preferred.

In like manner, it is generally necessary that the exit gas stream, now depleted of larger or denser particulates than those desired in the product, be upwardly extending. However, the exit stream direction need not be 90° to the inlet stream direction. It is important that there be a relatively abrupt change in gas flow direction, which allows for fine particles to continue in the gas stream, but which causes large or dense particles, due to their inertia, to impact the target. Thus, the change in flow direction and hence the included angle between the direction, or "axis" of the incoming gas stream (e.g., determined by the geometric axis of the piping or conduit through which it flows) and the outlet gas stream may be acute or obtuse, so long as classification is achieved to the desired degree. The included angle is generally between 30° and 150°, preferably between 60° and 120°. Most preferably, the included angle is about 90°. By the term "depleted" as used herein is meant a reduction in the number of undesired particulates, not their complete absence.

Thus, one aspect of the invention is directed to a classifying device suitable for classifying particulates entrained in a flowing gas stream. The device includes a flow stream inlet and an upwardly extending flow stream outlet. The flow stream inlet and flow stream outlet are angled with respect to each other such that the direction of flow of the flowing gas stream changes between the flow stream inlet and the flow stream outlet. The device has a volume between the flow stream inlet and the flow stream outlet through which the flowing gas stream flows. A target is positioned in the volume such that particles to be removed and entrained in the flowing gas stream contract the target and fall downward. A downwardly extending fluidized particle trap communicates with the volume, whereby particles of greater mass and/or density than the mass and/or density of particles targeted to remain in the flowing gas stream accumulate in the fluidized trap.

The subject invention classifiers are easily modified, and testing for efficient classification is routinely accomplished, as described in the Example which follows. Target shape, target penetration into the classifier "volume," any offset between exit flow stream and trap, etc., may all be easily and routinely tested. In addition, device configurations, gas flow rates, and the like may be modeled with fluid dynamics software. The classifiers of the present invention have the distinct advantage over sifters and other mechanical classifiers in that shearing of particles is minimized or completely eliminated.

The subject application further pertains to a method of classifying particulates from a stream of particle-laden gas, and to a process for removing particles which are heavier or denser than that desired of a particulate product, by causing the particulate-laden gas stream to flow through a classifier of the subject invention, obtaining a particulate product-laden gas outlet stream depleted of larger or denser particles from the classifier, and separating the desired particles from the gas stream as a solid, particulate product.

Having generally described this invention, a further understanding can be obtained by reference to certain specific examples which are provided herein for purposes of illustration only and are not intended to be limiting unless otherwise specified.

EXAMPLE 1

A classifier is constructed by removing a bottom portion of a standard 4-inch (10 cm) 90° stainless steel Tee fitting, and attaching a cylindrical trap, offset approximately 1.1 inches (2.79 cm) from the vertical outlet of the Tee, substantially as shown in FIGS. 2-5. The filler plates are of a thickness suitable for use with the expected system pressures, in this case 0.237 inch type 316 stainless steel. The bottom of the trap is connected to an air lock consisting of two valves in series. Both valves are closed during particle classification.

The classifier is tested by installing the classifier in a convey line in an isophthalic acid manufacturing process. An air lock is attached to the convey line upstream from the classifier position used for the introduction of test objects to the convey line. The gas velocity through the 4-inch (10 cm) gas convey line is approximately 50 ft/sec., the particle loading in the gas stream is about 12 $Kg/m^3$, and the desired particle sizes range from 20 μm to 400 μm. The gas convey line makes a 90° turn and is directed upwards over an approximately 4 ft. (1.2 m) rise prior to entry into the classifier.

To test the effectiveness of the classifier, a variety of foreign particles, as set forth in Table 1, are placed in the air lock installed in the convey line, the air lock closed, and then the bottom air lock valve communicating with the convey line opened, allowing the foreign objects to fall into the convey gas stream. The results of this first test are presented in Table 1. A recovery of slightly greater than 75% is obtained. As a result of the first test, the commercial sifter was removed from the process.

A second test is performed, but the convey piping is modified to remove the 90° turn and 4 ft. (1.2 m) rise prior to entry into the classifier so that the piping contains no bends for a length of 10 ft (3 m) prior to the classifier. The remainder of the test remains the same. A slightly higher recovery was obtained. The results of this second test are also presented in Table 1.

In addition to the particulates used in these two studies, smaller and less dense but still undesirable particulates were found to be effectively removed from the product stream as well.

TABLE 1

| | First Test | | | Second Test | | |
|---|---|---|---|---|---|---|
| Object | # Dropped | # Caught | % Caught | # Dropped | # Caught | % Caught |
| ¼ Nut | 8 | 7 | 87.5 | 5 | 5 | 100 |
| ¼ × ½ Bolt | 5 | 5 | 100 | 8 | 7 | 87.5 |
| #8 Nut | 8 | 7 | 87.5 | 5 | 5 | 100 |
| #6 Nut | 5 | 2 | 40 | 5 | 4 | 80 |
| ¼ Lock Washer | 6 | 4 | 66.7 | 5 | 4 | 80 |
| ⅜ Back Ferrule | 8 | 5 | 62.5 | 5 | 3 | 60 |
| 6 × ½ Brass Machine Screws | 5 | 4 | 80 | 5 | 2 | 40 |
| Total | 45 | 34 | 75.6 | 38 | 30 | 78.9 |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A classifying device suitable for classifying particulates entrained in a flowing gas stream, comprising:

a) a flow stream inlet and an upwardly extending flow stream outlet, said flow stream inlet and flow stream outlet angled with respect to each other such that the direction of flow of said flowing gas stream changes between said flow stream inlet and said flow stream outlet, said device having a volume between said flow stream inlet and said flow stream outlet through which said flowing gas stream flows;

b) a target positioned in said volume such that particles to be removed and entrained in said flowing gas stream contract said target and fall downward; and c) a downwardly extending fluidized particle trap communicating with said volume, said fluidized particle trap having at least one fluidizing gas inlet, whereby particles of greater mass and/or density than the mass and/or density of particles targeted to remain in the flowing gas stream accumulate in said fluidized trap, wherein a restrictive ring is fixed to the inside of said fluidized trap, said restrictive ring being a ring of conical section having a height, and said fluidizing gas enters said trap at a location in the trap walls within the height of said ring of conical section.

2. The classifying device of claim 1, wherein said upwardly extending flow stream outlet extends upward at an outlet included angle of from 30° to 150° relative to the direction of gas flow through said flow stream inlet.

3. The classifying device of claim 2, wherein the outlet included angle relative to the direction of gas flow through said flow stream inlet is between 60° and 120°.

4. The classifying device of claim 1, wherein said downwardly extending fluidized particle trap extends downwardly at a trap included angle between 30° and 150° relative to the direction of gas flow through said flow stream inlet.

5. The classifying device of claim 4, wherein said trap included angle is between 60° and 120°.

6. The classifying device of claim 4, wherein said trap included angle is about 90°.

7. The classifying device of claim 1, wherein said downwardly extending particle trap has a trap geometric axis and said upwardly extending flow stream outlet has an outlet geometric axis, said trap geometric axis and said outlet geometric axis offset from each other.

8. A method for classifying particulates entrained in a flowing gas stream, comprising:

positioning a classifier of claim 1 into the path of said flowing gas stream; and obtaining an outlet gas stream depleted of undesired particulates.

9. The method of claim 8, wherein said particles comprise particles of an aromatic acid.

10. The method of claim 9, wherein said aromatic acid is an aromatic dicarboxylic acid, and said gas comprises nitrogen.

11. The method of claim 10, wherein said aromatic dicarboxylic acid is selected from the group consisting of phthalic acid, terephthalic acid, and isophthalic acid.

12. A method for classifying particulates entrained in a flowing gas stream, comprising:

positioning a classifier of claim 2 into the path of said flowing gas stream; and obtaining an outlet gas stream depleted of undesired particulates.

13. A method for classifying particulates entrained in a flowing gas stream, comprising:

positioning a classifier of claim 3 into the path of said flowing gas stream; and obtaining an outlet gas stream depleted of undesired particulates.

14. A method for classifying particulates entrained in a flowing gas stream, comprising:

positioning a classifier of claim 4 into the path of said flowing gas stream; and obtaining an outlet gas stream depleted of undesired particulates.

15. A method for classifying particulates entrained in a flowing gas stream, comprising:

positioning a classifier of claim 5 into the path of said flowing gas stream; and obtaining an outlet gas stream depleted of undesired particulates.

16. The method of claim 8, further comprising removing undesired particulates from said fluidized trap.

17. A classifying device suitable for classifying particulates entrained in a flowing gas stream, comprising:

a) a flow stream inlet and an upwardly extending flow stream outlet, said flow stream inlet and flow stream outlet angled with respect to each other such that the direction of flow of said flowing gas stream changes between said flow stream inlet and said flow stream outlet, said device having a volume between said flow stream inlet and said flow stream outlet through which said flowing gas stream flows;

b) a target positioned in said volume such that particles to be removed and entrained in said flowing gas stream contract said target and fall downward;

c) a downwardly extending fluidized particle trap communicating with said volume; and means for fluidizing said particulates in said trap, whereby particles of greater mass and/or density than the mass and/or density of particles targeted to remain in the flowing gas stream accumulate in said fluidized trap.

18. The classifying device of claim 17, wherein said upwardly extending flow stream outlet extends upward at an outlet included angle of from 30° to 150° relative to the direction of gas flow through said flow stream inlet.

19. The classifying device of claim 18, wherein the outlet included angle relative to the direction of gas flow through said flow stream inlet is between 60° and 120°.

20. The classifying device of claim 17, wherein said downwardly extending fluidized particle trap extends downwardly at a trap included angle between 30° and 150° relative to the direction of gas flow through said flow stream inlet.

21. The classifying device of claim 20, wherein said trap included angle is between 60° and 120°.

22. The classifying device of claim 20, wherein said trap included angle is about 90°.

23. The classifying device of claim 17, wherein said downwardly extending particle trap has a trap geometric axis and said upwardly extending flow stream outlet has an outlet geometric axis, said trap geometric axis and said outlet geometric axis offset from each other.

* * * * *